US006338038B1

(12) United States Patent
Hanson

(10) Patent No.: US 6,338,038 B1
(45) **Date of Patent: *Jan. 8, 2002**

(54) VARIABLE SPEED AUDIO PLAYBACK IN SPEECH RECOGNITION PROOFREADER

(75) Inventor: Gary Robert Hanson, Palm Beach Gardens, FL (US)

(73) Assignee: International Business Machines Corp., Armonk, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/145,782

(22) Filed: Sep. 2, 1998

(51) Int. Cl.[7] ..... G10L 19/00; G10L 21/00
(52) U.S. Cl. ..... 704/500; 704/270; 704/275
(58) Field of Search ..... 704/500, 270, 704/275

(56) References Cited

U.S. PATENT DOCUMENTS 5,125,023 A * 6/1992 Morduch et al. ..... 379/88
5,153,579 A * 10/1992 Fisch et al. ..... 340/825.22
5,651,054 A * 7/1997 Dunn et al. ..... 379/67
5,652,828 A * 7/1997 Silverman ..... 704/260
5,732,216 A * 3/1998 Logan et al. ..... 395/200.33
5,768,126 A * 6/1998 Frederick ..... 364/400.01
5,850,629 A * 12/1998 Holm et al. ..... 704/260
5,915,001 A * 6/1999 Uppaluru ..... 379/88.22
5,920,838 A * 6/1999 Mostow et al. ..... 704/255
6,161,092 A * 12/2000 Latshaw et al. ..... 704/270
6,173,259 B1 * 1/2001 Bijl et al. ..... 704/235

* cited by examiner

*Primary Examiner*—Richemond Dorvil
*Assistant Examiner*—Michael N. Opsasnick
(74) *Attorney, Agent, or Firm*—Akerman Senterfitt

(57) ABSTRACT

A method for inserting a delay between the playback of individual words or phrases by a speech recognition system, comprises the steps of: (A) waiting for a playback command; (B) measuring a delay upon occurrence of the playback command; (C) initiating playback of only one of the individual words or phrases upon expiration of the delay; (D) waiting for a subsequent playback command; and, (E) upon occurrence of the subsequent playback command, repeating the steps (B), (C) and (D) for playing subsequent ones of the individual words or phrases, one at a time. The method can further comprise the steps of: (F) comparing a user requested delay to a predetermined delay; (G) changing from one at a time playback to continuous playback whenever the user requested delay is not greater than the predetermined delay; and, (H) changing from continuous playback to one at a time playback whenever the user requested delay is greater than the predetermined delay.

15 Claims, 4 Drawing Sheets

10

| TABLE OF GLOBAL VARIABLES | | |
|---|---|---|
| Variable | Type | Description |
| TagArray | Array | Contains an array of tags in the sequence in which they should be played. |
| gStartIndex | Number | Index into TagArray, indicating the first tag that should be loaded into the speech system for playback. |
| gEndIndex | Number | Index into TagArray, indicating the last tag that should be loaded into the speech system for playback. |
| gCurrentIndex | Number | Contains the index of the currently playing tag. |
| gDelay | Number | Contains a value corresponding to the delay to be inserted between the playback of each word in the multiple call mode. Default = 0 (No Delay) |
| gMode | Number | Contains a value corresponding to the mode: single call or multiple call mode. Default = single call |
| gState | Number | Contains a value representing the current state of the proofreader. Default = READY (Other values are PLAYING or PAUSED) |

*FIG. 1*

VARIABLE SPEED AUDIO PLAYBACK IN SPEECH RECOGNITION PROOFREADER

BACKGROUND OF THE INVENTION

1. Field of the Invention

This invention relates to the field of speech recognition applications, and in particular, to a method and apparatus for controllably varying audio playback speed in a speech recognition proofreader.

2. Description of Related Art

The detection of errors in a document dictated via speech recognition software is facilitated by a proofreading program that plays the originally dictated audio while simultaneously displaying and/or highlighting the text interpreted by the speech system. Proofreading programs operating in a speech recognition system can play dictated audio synchronized with the display and/or highlighting of the recognized text. Playback facilitates the detection of misrecognized words. As each recognized utterance is played, its corresponding text is also "played", that is, displayed. Such a mechanism helps the user detect incongruities more easily than by visual inspection alone. In addition, the proofreader provides a "marking" capability, allowing the user to mark such errors for later correction. The proofreader stores the marks and allows the user to review them and correct the corresponding text at a later time. However, some speakers dictate so rapidly that during playback the errors are not easily seen, or even if seen, the playback is too rapid for the user the user to accurately mark the error, since the next word may already be playing by the time the user has acted. However, by automatically pausing between each dictated utterance the pace of the playback can be controlled and the user can be afforded the time required to accurately mark the errors.

A typical speech recognition system provides the ability to play the dictated audio for any recognized spoken word. In accordance with this capability, a typical speech recognition system will embody the following features. A first feature is to provide a client with a number ("tag") that uniquely identifies an individual spoken word or phrase as defined by the speech recognition system. A second feature is that the speech recognition system can be loaded with a memory address pointing to an array of tags and can be directed to play a specific number or range of those tags. A third feature is that the speech recognition system notifies the caller whenever the system has begun playing an individual tag and provides the tag associated with the current spoken word or phrase. The notification occurs asynchronously through the use of a callback function specified by the proofreader and executed by the speech engine. A fourth feature is that the speech recognition system notifies the caller when all the tags have been played. The notification occurs asynchronously through the use of a callback function specified by the proofreader and executed by the speech engine. Such notifications will be generically referred to as "AudioDone" notifications.

There is a long-felt need for methods and apparatus to slow, and even variably control, the pace of playback to overcome this difficulty. There is a further long-felt need to control the pace of playback during proofreading by utilizing the features and capabilities of typical speech recognition systems, as described above.

SUMMARY OF THE INVENTION

In accordance with the inventive arrangements, the capabilities and features of speech recognition systems can be advantageously used in a novel and nonobvious manner to provide the fastest possible playback, to slow the playback and to adjust the speed of playback while playback is in progress.

A single call mode is provided for the fastest possible playback, in accordance with which the speech system is loaded with an array of tags and is then directed to play the entire array as one unit.

A multiple call mode is provided for playing each tag individually at slower and variable speeds, one at a time. A range of tags is played by making multiple calls to the speech system to load and play each tag individually, inserting a delay between each call. The delay can be variable.

A method for inserting a delay between the playback of individual words or phrases as recognized by a speech recognition system, in accordance with the inventive arrangements, comprises the steps of: (A) waiting for a playback command; (B) measuring a delay upon occurrence of the playback command; (C) initiating playback of only one of the individual words or phrases upon expiration of the delay; (D) waiting for a subsequent playback command; and, (E) upon occurrence of the subsequent playback command, repeating the steps (B), (C) and (D) for playing subsequent ones of the individual words or phrases, one at a time.

The method can further comprise the steps of: (F) generating a user interface for detecting the playback command and playing back the individual words and phrases; and, (G) executing the steps (A), (B), (C), (D) and (E) in an independent thread of execution.

The method can also further comprise the steps of: (F) tracking the playback of the individual words and phrases according to an ordered index; (G) issuing a notification each time a playback of one of the individual words or phrases is completed; (H) automatically repeating the steps (B), (C) and (D) for playing subsequent ones of the individual words or phrases responsive to each notification; and, (I) continuing the playing back until all unplayed ones of the individual word or phrases in the ordered index are played back.

In the basic method, and in each of the alternatives, the method can further comprise the step of varying the delay responsive to a user requested delay.

When user requested delays are made, the method can further comprise the steps of: comparing the user requested delay to a predetermined delay; repeating the step (E) if the user requested delay is greater than the predetermined delay; and, terminating the step (E) if the user requested delay is not greater than the predetermined delay. The method can further comprising the step of initiating playback of the individual or words or phrases as a continuous stream responsive to the terminating step.

When user requested delays are made, the method can also further comprise the steps of: comparing the user requested delay to a predetermined delay; changing from playing back the individual words or phrases one at a time to playing back the individual words or phrases as a continuous stream whenever the user requested delay is not greater than the predetermined delay; and, changing from playing back the individual words or phrases as a continuous stream to playing back the individual words or phrases one at a time whenever the user requested delay is greater than the predetermined delay.

BRIEF DESCRIPTION OF THE DRAWINGS

FIG. 1 is a Table defining global variables used in the flow charts of FIGS. 2–5.

DETAILED DESCRIPTION OF THE PREFERRED EMBODIMENTS

Figure 2:
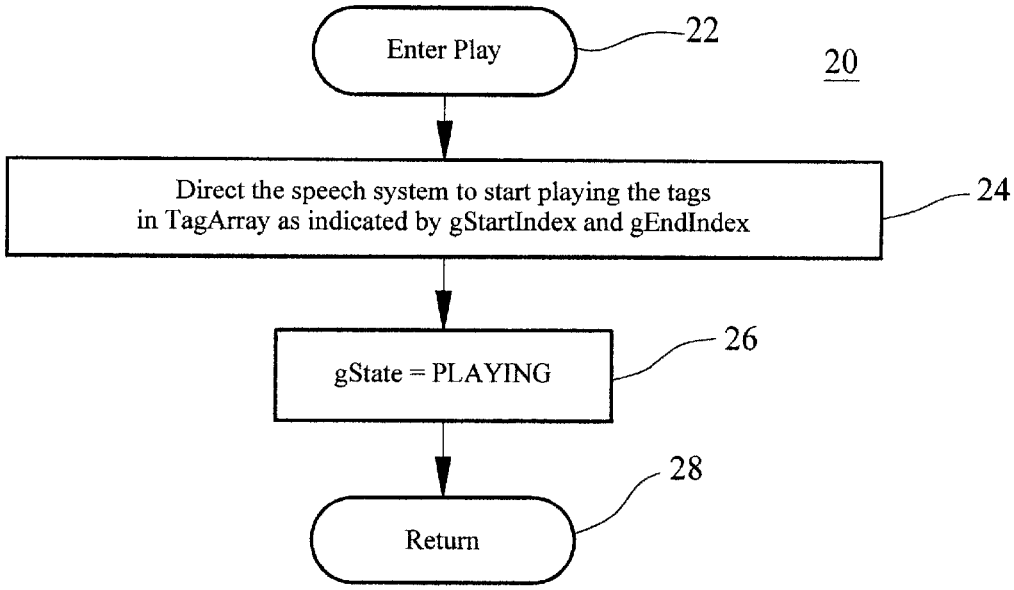
FIG. 2 is a flow chart useful for explaining the core logic for playing an array of tags.

The methods and apparatus taught herein are appropriate for speech recognition systems providing the capability to play the dictated audio for any recognized spoken word. In accordance with this capability, a typical speech recognition system will embody the following features: (1) providing a client with a number ("tag") that uniquely identifies an individual spoken word or phrase as defined by the speech recognition system; (2) the speech recognition system can be loaded with a memory address pointing to an array of tags and can be directed to play a specific number or range of those tags; (3) the speech recognition system notifies the caller whenever the system has begun playing an individual tag and provides the tag associated with the current spoken word or phrase; (4) the notification occurs asynchronously through the use of a callback function specified by the proofreader and executed by the speech engine; (5) the speech recognition system notifies the caller when all the tags have been played; and, (6) the notification occurs asynchronously through the use of a callback function specified by the proofreader and executed by the speech engine, such notifications being generically referred to as "AudioDone" notifications.

The fastest playback occurs when a range of text is played as a single unit. The pace is then determined by that of the original speaker. The ability to slow the pace involves the playing of individual words one at a time, automatically pausing between each word as required. The ability to adjust the speed while playing involves keeping track of the current position and range of words to play, adjusting the pause value and toggling between playing a sequence and playing individual words.

In order to toggle between the fastest playback possible and the insertion of a delay between each word, two playback modes are defined and implemented. A single call mode is defined as a mode wherein the speech system is loaded with an array of tags and is then directed to play the entire array as one unit. A multiple call mode is defined as a mode wherein the speech system is directed to play each tag individually, one at a time. A range of tags is played by making multiple calls to the speech system to load and play each tag individually, inserting a delay between each call.

A important feature distinguishing the two modes is in the quality of the playback, with the single call mode offering the most natural sounding playback. For instance, suppose the user dictated "I like to drive." Each of the individual words has an associated tag, making four tags in all. In the single call mode all four tags are played as one unit. The logic of the speech system is such that the playback sounds natural. That is, the playback sounds as if the user were speaking the entire phrase in the user's normal voice. On the other hand, when played in the multiple call mode, the tags are individually loaded and played one at a time. Unfortunately, the present state of speech recognition technology is such that the playback of an individual word may often contain portions of the preceding and following words. For instance, when the word "to" is played back the user may hear the trailing edge of "like", the word "to", and the leading edge of the word "drive". This limitation of the multiple call mode is a secondary reason for providing the single call mode.

In order for the proofreader of the speech application to determine which mode to use, a constant value named Threshold is defined. If the desired delay is below the Threshold value, then the single call mode is used; otherwise the multiple call mode is used.

Several global variables are used throughout the proofreader to control playback. These variables are defined in the Table 10 shown in FIG. 1.

TagArray is an Array type variable containing an array of tags in the sequence in which they should be played. gStartIndex is a Number type variable providing an index into TagArray and indicating the first tag that should be loaded into the speech system for playback. gEndIndex is a Number type variable providing an index into TagArray and indicating the last tag that should be loaded into the speech system for playback. gCurrentIndex is a Number type variable containing the index of the currently playing tag. gDelay is a Number type variable containing a value corresponding to the delay to be inserted between the playback of each word in the multiple call mode. The default value=0; that is, no delay. gMode is a Number type variable containing a value corresponding to the mode: single call or multiple call. The default value=single call. gState is a Number type variable containing a value representing the current state of the proofreader. The default value=READY. Other values are PLAYING or PAUSED.

Understanding the logic of the playback is a prerequisite to explaining the setting of the delay to change the pace of speech audio playback. FIG. 2 is a flow chart 20 illustrating the core logic for playing an array of tags, including an array containing just one tag. If gStartIndex and gEndIndex are equal then only one tag is played. The playback mode is entered in the step of block 22. Next, provide the address of the first element of the array to the speech system in the step of block 24, and in the same block, call a speech system function to play the range of tags specified. In the step of block 26, set the variable state gState to indicate that the proofreader and speech system are playing. Upon the call's return in the step of block 28, exit the Play function and return to the caller.

It is important that the speech system function to play the tags operates asynchronously, that is, in a separate thread. This allows the primary process code, including the graphical user interface, to continue its operation while the playback is underway. Therefore, the speech system function that plays the tags returns immediately after initiating playback and does not wait until playback has completed.

Figure 3:
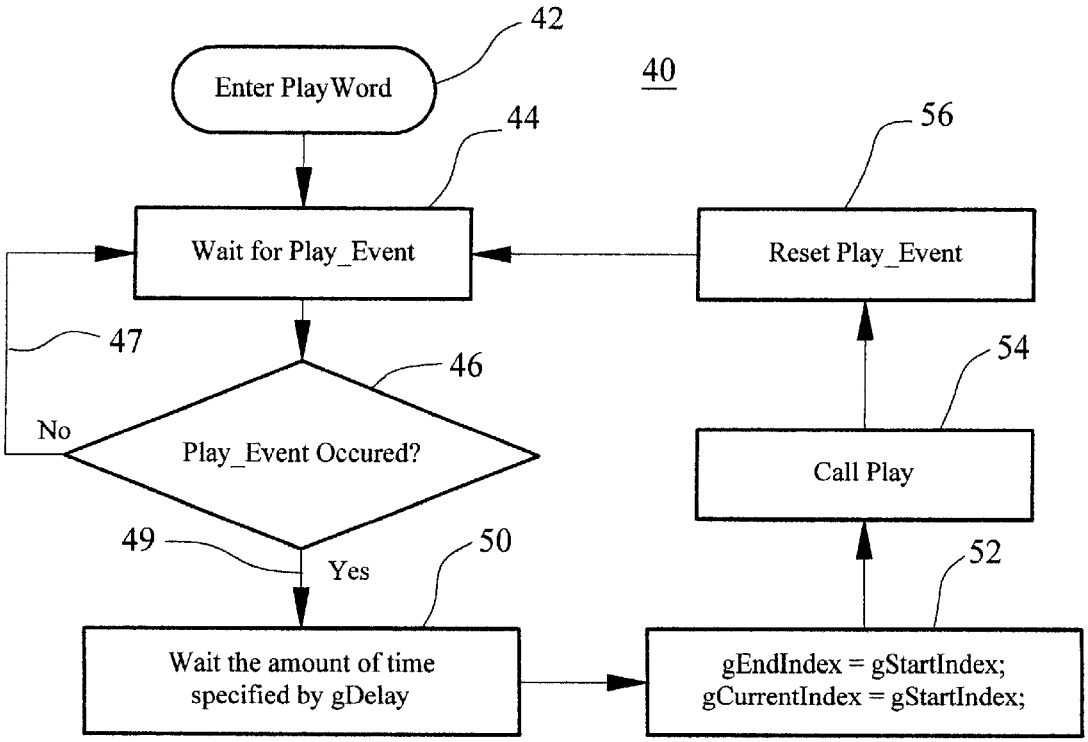
FIG. 3 is a flow chart useful for explaining the multiple call mode.

FIG. 3 is a flow chart 40 illustrating the logic for playing the words individually in the multiple call mode. Enter the PlayWord function in the step of block 42 and begin waiting for a Play_Event to be set in the step of block 44 and the NO output path 47 of decision block 46. If a Play_Event is set then proceed on the YES output path 49 of decision block 44 to the step of block 50, in accordance with which the code is delayed for an amount of time as specified in gDelay. Once the delay has elapsed, gEndIndex is set equal to gStartIndex in accordance with the step of block 52, ensuring that only one tag will be played. The current index is also set to gStartIndex in the step of block 52. The Play function is called in accordance with the step of block 54 and Play_Event is reset in accordance with the step of block 56.

The code then waits again for Play_Event to be set, in accordance with the steps of blocks 44 and 46, and the NO path 47.

It is helpful to appreciate that the Play_Event refers generically to any a mechanism that can be used to alert PlayWord to play the next word. Play_Event can use one or more local variables, global variables or system synchronization objects such as semaphores, mutexes and the like. For purposes of this explanation, Play_Event is a standard event object as defined by Windows 95®.

Since PlayWord uses a delay which effectively blocks the execution of code until the delay has elapsed, it is preferable, indeed it is intended that PlayWord be executed in a separate thread of execution as provided in most operating systems today. By doing so, the main body of the code, especially the user interface, can continue to operate.

Figure 4:
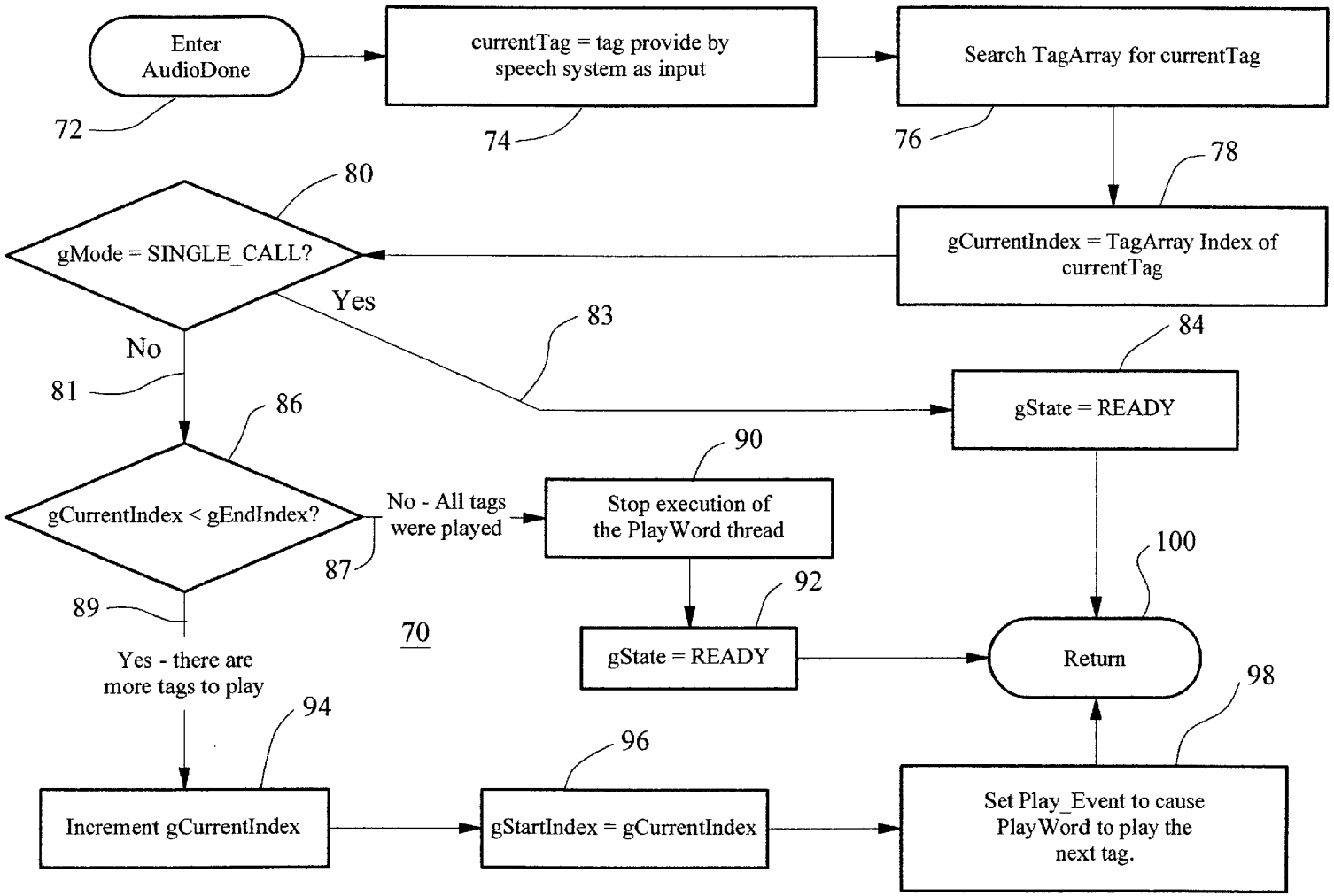
FIG. 4 is a flow chart useful for explaining the AudioDone notification.

FIG. 4 is a flow chart 70 illustrating processing of the AudioDone notification from the speech engine. Every time a tag is played the speech engine notifies the proofreader, providing the proofreader with the tag, referred to herein as "currentTag", by passing the tag as input to the callback. The main purpose of AudioDone is to play the next tag, if any, if the playback mode is multiple call.

The AudioDone callback begins at block 72. In accordance with the step of block 74 the currentTag is set to the tag provided by the speech system as input, the TagArray is searched for the currentTag in accordance with the step of block 76, and in accordance with the step of block 78, the TagArray index of the curentTag is stored in gCurrentIndex.

The next step in accordance with decision block 80 is a determination of the playback mode. If the playback mode is single call, then all the tags as requested have been played, so the method branches on path 83 to the step of block 84 in accordance with which gState is set to READY, and the callback simply returns in accordance with the step of block 100.

However, if the playback mode is multiple call, the AudioDone callback is being executed because a single tag as specified by PlayWord has been played. Therefore, it is necessary to determine if there are more tags left to play. Accordingly the method branches on path 81 to decision block 86, which asks whether the gCurrentIndex is less than gEndIndex. This is equivalent to asking whether there are more tags remaining to be played. If not, the method branches on path 87 to the step of block 90, in accordance with which execution of the PlayWord thread is stopped. Thereafter, gState is set to READY in accordance with the step or block 92, and the callback returns in accordance with the step of block 100.

If there are more tags to play, the method branches on path 89 to the step of block 94, in accordance with which gCurrentIndex is incremented to point to the next tag. The gStartIndex is then set equal to gCurrentIndex in accordance with the step of block 96, which sets the Play_Event to cause PlayWord to play the tag specified by gStartIndex, in accordance with the step of block 98. Finally, the callback returns in accordance with the step of block 100.

Figure 5:
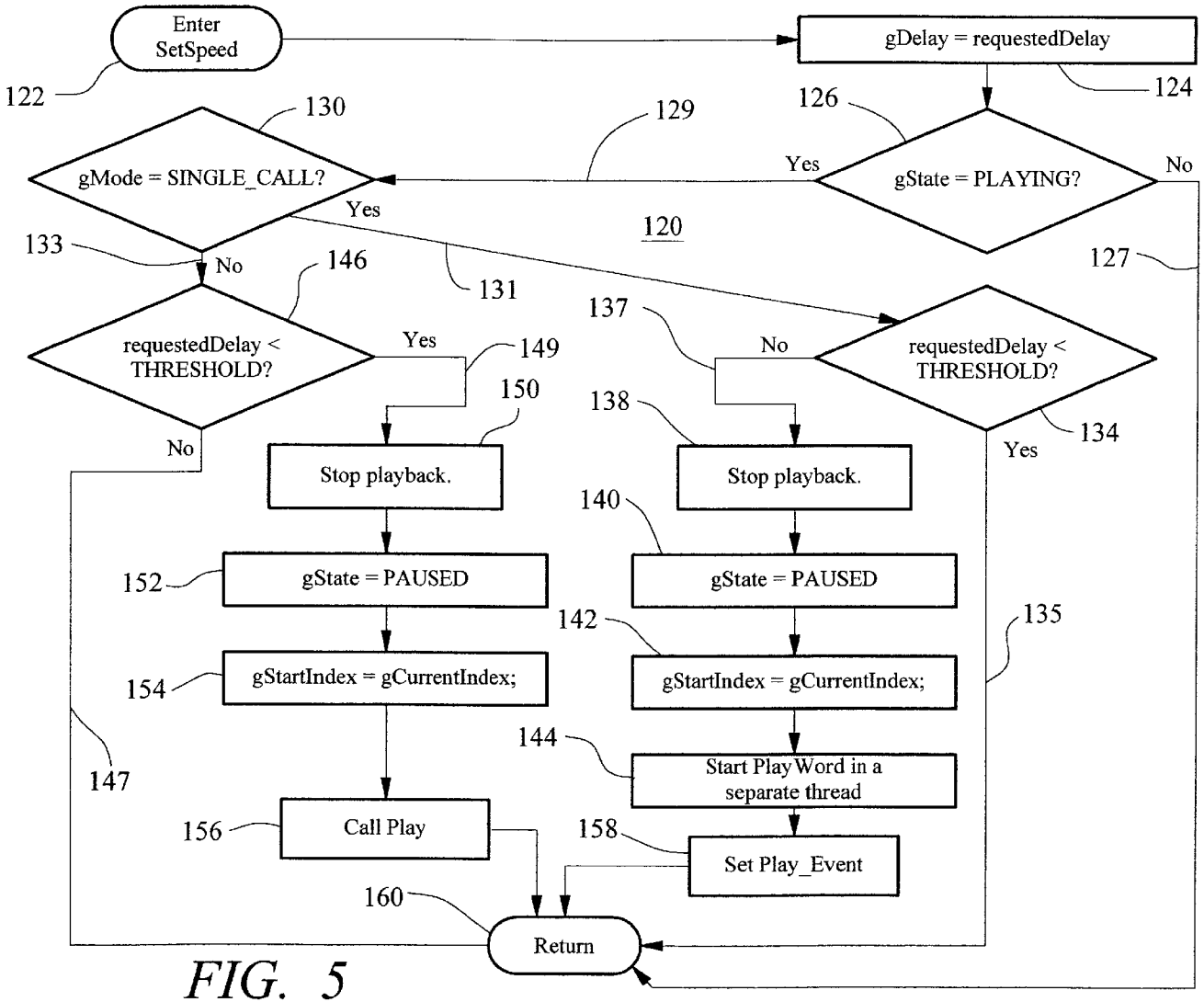
FIG. 5 is a flow chart useful for explaining the variable speed playback.

FIG. 5 is a flow chart 120 illustrating the main processing for the SetSpeed function. The SetSpeed function is entered in the step of block 122. The SetSpeed function accepts a delay value, denoted requestedDelay, as an input parameter and stores the delay in gDelay, in accordance with the step of block 124. The speech system must first determine if the speech system is playing. If gState is not set to playing, in accordance with the step of decision block 126, the method branches on path 127 and the call returns in accordance with the step of block 160. If gState is set to playing, the method branches on path 129 to the step of decision block 130 so the proofreader can determine whether the new delay value will require a playback mode change.

If gMode is set to the single call mode, as determined by the step of decision block 130, the proofreader is in the single call mode. The program branches on path 131 to the step of decision block 134.

If the requestedDelay is less than the Threshold, the method branches on path 135 to the step of block 160, in accordance with which the call returns. In other words, no delay is required.

If the requestedDelay is not less than the Threshold, a mode change is required and the method branches on path 137 to block 138. SetSpeed stops the current playback in accordance with the step of block 138, sets the global state variable gState to indicate that the proofreader is paused in accordance with the step of block 140, stores the index of the currently playing tag index, gCurrentIndex, in the global variable gStartIndex in accordance with the step of block 142, starts PlayWord in a separate thread in accordance with the step of block 144, sets Play_Event in accordance with the step of block 158 to initiate playback and then returns in accordance with the step of block 160.

If gMode is not set to the single call mode, as determined by the step of decision block 130, the proofreader is in the multiple call mode. The program branches on path 147 to the step of decision block 146.

If the requestedDelay is not less than the Threshold, the method branches on path 147 to the step of block 160, in accordance with which the call returns.

If the requestedDelay is less than the Threshold, a mode change is required and the method branches on path 149 to block 150. SetSpeed stops the current playback in accordance with the step of block 150, sets the global state variable gState to indicate that the proofreader is paused in accordance with the step of block 152, stores the index of the currently playing tag index, gcurrentIndex, in the global variable gStartindex in accordance with the step of block 154, starts Play in accordance with the step of block 156, and then returns in accordance with the step of block 160.

Stopping playback in the single call mode is accomplished by calling a speech function to abort the current playback. Stopping playback in the multiple call mode is accomplished by suspending the PlayWord thread's execution or by destroying the thread in its entirety. Since destroying the thread is easier, that alternative is presently preferred.

The inventive arrangements provide an effective and user friendly mechanism for changing the pace of dictated audio playback in a proofreader using current speech recognition technology.

What is claimed is:

1. A method for inserting a delay between the playback of individual speech recognized words or phrases responsive to a user playback command, said method comprising the steps of:

(A) receiving a play event for initiating playback of only one of said individual speech recognized words or phrases;

(B) responsive to receiving said play event, pausing for a delay period;

(C) when said delay period has lapsed, initiating playback of only one of said individual speech recognized words or phrases;

(D) waiting for a subsequent play event; and, (E) upon receiving said subsequent play event, repeating said steps (B), (C), and (D) for playing subsequent ones of said individual speech recognized words or phrases, one at a time.

2. The method of claim 1, further comprising the steps of:

(F) generating a user interface for detecting said playback command and playing back said individual words and phrases; and, (G) executing said steps (A), (B), (C), (D) and (E) in an independent thread of execution.

3. The method of claim 1, further comprising the steps of:

(F) tracking said playback of said individual words and phrases according to an ordered index;

(G) issuing a notification each time a playback of one of said individual words or phrases is completed;

(H) automatically repeating said steps (B), (C) and (D) for playing subsequent ones of said individual words or phrases responsive to each said notification; and, (I) continuing said playing back until all unplayed ones of said individual word or phrases in said ordered index are played back.

4. The method of claim 3, further comprising the step of:

(J) varying said delay responsive to a user requested delay.

5. The method of claim 1, further comprising the step of:

(F) varying said delay responsive to a user requested delay.

6. The method of claim 4, further comprising the steps of:

(K) comparing said user requested delay to a predetermined delay;

(L) repeating said step (E) if said user requested delay is greater than said predetermined delay; and, (M) terminating said step (E) if said user requested delay is not greater than said predetermined delay.

7. The method of claim 5, further comprising the steps of:

(G) comparing said user requested delay to a predetermined delay;

(H) repeating said step (E) if said user requested delay is greater than said predetermined delay; and, (I) terminating said step (E) if said user requested delay is not greater than said predetermined delay.

8. The method of claim 6, further comprising the step of:

(N) initiating playback of said individual or words or phrases as a continuous stream responsive to said terminating step (M).

9. The method of claim 7, further comprising the step of:

(J) initiating playback of said individual or words or phrases as a continuous stream responsive to said terminating step (I).

10. The method of claim 8, further comprising the steps of:

(F) generating a user interface for detecting said playback command and playing back said individual words and phrases; and, (G) executing said steps (A), (B), (C), (D) and (E) in an independent thread of execution.

11. The method of claim 9, further comprising the steps of:

(F) generating a user interface for detecting said playback command and playing back said individual words and phrases; and, (G) executing said steps (A), (B), (C), (D) and (E) in an independent thread of execution.

12. The method of claim 4, further comprising the steps of:

(K) comparing said user requested delay to a predetermined delay;

(L) changing from playing back said individual words or phrases one at a time to playing back said individual words or phrases as a continuous stream whenever said user requested delay is not greater than said predetermined delay; and, (M) changing from playing back said individual words or phrases as a continuous stream to playing back said individual words or phrases one at a time whenever said user requested delay is greater than said predetermined delay.

13. The method of claim 5, further comprising the steps of:

(G) comparing said user requested delay to a predetermined delay;

(H) changing from playing back said individual words or phrases one at a time to playing back said individual words or phrases as a continuous stream whenever said user requested delay is not greater than said predetermined delay; and, (I) changing from playing back said individual words or phrases as a continuous stream to playing back said individual words or phrases one at a time whenever said user requested delay is greater than said predetermined delay.

14. The method of claim 12, further comprising the steps of:

(N) generating a user interface for detecting said playback command and playing back said individual words and phrases; and, (O) executing said steps (A), (B), (C), (D) and (E) in an independent thread of execution.

15. The method of claim 13, further comprising the steps of:

(J) generating a user interface for detecting said playback command and playing back said individual words and phrases; and, (K) executing said steps (A), (B), (C), (D) and (E) in an independent thread of execution.

* * * * *